US011511556B2

(12) United States Patent
Suzuki et al.

(10) Patent No.: US 11,511,556 B2
(45) Date of Patent: Nov. 29, 2022

(54) PRINTER

(71) Applicant: Roland DG Corporation, Hamamatsu (JP)

(72) Inventors: Akihiro Suzuki, Hamamatsu (JP); Atsushi Oguri, Hamamatsu (JP); Teruma Otsuka, Hamamatsu (JP)

(73) Assignee: ROLAND DG CORPORATION, Shizuoka (JP)

( * ) Notice: Subject to any disclaimer, the term of this patent is extended or adjusted under 35 U.S.C. 154(b) by 0 days.

(21) Appl. No.: 17/392,295

(22) Filed: Aug. 3, 2021

(65) Prior Publication Data

US 2022/0040997 A1 Feb. 10, 2022

(30) Foreign Application Priority Data

Aug. 4, 2020 (JP) ..... JP2020-132383

(51) Int. Cl.
*B41J 25/308* (2006.01)
*B41J 11/20* (2006.01)

(52) U.S. Cl.
CPC ..... *B41J 25/3086* (2013.01); *B41J 11/20* (2013.01); *B41J 25/308* (2013.01); *B41J 25/3088* (2013.01)

(58) Field of Classification Search
CPC ..... B41J 25/3086; B41J 11/20; B41J 25/308; B41J 25/3088
See application file for complete search history.

(56) References Cited

U.S. PATENT DOCUMENTS

2018/0272713 A1 9/2018 Otokita et al.
2019/0358969 A1* 11/2019 Muraoka ..... B41J 25/00
2020/0361211 A1* 11/2020 Suzuki ..... B41J 2/16508

FOREIGN PATENT DOCUMENTS

JP 62-244841 A 10/1987
JP 2007-168278 A 7/2007
JP 2010-111091 A 5/2010
JP 2012-228778 A 11/2012
JP 2013-001004 A 1/2013
JP 2018-161744 A 10/2018

* cited by examiner

*Primary Examiner* — Henok D Legesse
(74) *Attorney, Agent, or Firm* — Keating & Bennett, LLP

(57) ABSTRACT

A printer includes a supporting table to support a recording medium, a recording head located above the supporting table to eject ink toward the supporting table, a first contact detector located above the supporting table and lower than the recording head, an oscillator to vibrate the first contact detector, and a vibration detector to detect vibration of the first contact detector and transmit a signal corresponding to the detected vibration. The printer stores a threshold related to the vibration of the first contact detector and determines that an object has come into contact with the first contact detector when an amount of the vibration detected by the vibration detector is equal to the threshold or less.

11 Claims, 9 Drawing Sheets

PRINTER

CROSS-REFERENCE TO RELATED APPLICATIONS

This application claims the benefit of priority to Japanese Patent Application No. 2020-132383, filed on Aug. 4, 2020. The entire contents of this application are incorporated herein by reference.

BACKGROUND OF THE INVENTION

1. Field of the Invention

The present invention relates to a printer.

2. Description of the Related Art

Conventionally, printers that can handle recording media having various thicknesses have been known. Such printers include printers configured such that a supporting table for a recording medium moves in an up-down direction. Some of these printers have a mechanism that measures a height of the recording medium and is configured to move the supporting table in the up-down direction only in a range where the recording medium and a recording head are not in contact with each other. For example, Japanese Laid-open Patent Publication No. 2013-001004 discloses a printer including a table that supports a recording medium, a moving mechanism that moves the table in an up-down direction and in a front-rear direction, a plate-like detection member that extends in a left-right direction and contacts the recording medium, a fixing member that swingably supports the detection member in a front-rear direction, and a sensor that detects that the detection member has leaned. In the printer disclosed in Japanese Laid-open Patent Publication No. 2013-001004, when the detection member comes in contact with the recording medium while the moving mechanism moves the table in the front-rear direction, the detection member rotates. The rotation of the detection member is detected by the sensor. Thus, it is detected that the recording medium is at a height equal to or higher than that of the detection member.

Printers including a mechanism that detects an obstacle that is likely to come into contact with a recording head have been also conventionally known. For these printers, it is not necessarily premised that a supporting table moves in an up-down direction, but it is common for such printers and the printer disclosed in Japanese Laid-open Patent Publication No. 2013-001004 that an object that relatively moves with respect to a recording head is detected. For example, Japanese Laid-open Patent Publication No. 2010-111091 discloses a printer including a light emitting element that irradiates a recording medium with light and is configured to detect waviness of the recording medium, based on a reflecting direction of reflection light. In Japanese Laid-open Patent Publication No. 2010-111091, an obstacle is a wavy portion of the recording medium.

In a height detection mechanism that detects a height of a recording medium, as disclosed in Japanese Laid-open Patent Publication No. 2013-001004, a contact with the recording medium cannot be detected unless the detection member is inclined by a predetermined angle, and therefore, detection accuracy is not very high. However, if an angle at which the sensor reacts is reduced in order to increase the detection accuracy, a probability of false detection is increased. An obstacle detection mechanism described in Japanese Laid-open Patent Publication No. 2010-111091 detects an obstacle, based on a reflecting direction of reflection light. Therefore, it is difficult to detect an obstacle, such as a transparent recording medium or the like, having a low light reflectance. As described above, certainty of detection of a known mechanism that detects a recording medium or an obstacle is not necessarily high.

SUMMARY OF THE INVENTION

Preferred embodiments of the present invention provide printers that each more reliably detect a recording medium or an obstacle.

A printer disclosed herein includes a supporting table to support a recording medium, a recording head located above the supporting table to eject ink toward the supporting table, a first contact detector located above the supporting table and lower than the recording head, an oscillator to vibrate the first contact detector, a vibration detector to detect vibration of the first contact detector and transmit a signal corresponding to the detected vibration, and a controller. The controller is configured or programmed to include a signal receiver, a threshold storage, and a contact determinator. The signal receiver receives a signal from the vibration detector. The threshold storage stores a threshold related to the vibration of the first contact detector. The contact determinator determines that an object has come into contact with the first contact detector when an amount of the vibration detected by the vibration detector is equal to the threshold or less.

According to the printer, when an object comes into contact with the first contact detector, vibration applied to the first contact detector by the oscillator attenuates. As a result of the vibration detector detecting this attenuation, it can be determined that an object has come into contact with the first contact detector. In the printer, vibration of the first contact detector is spontaneously applied by the printer. Therefore, a state in which the first contact detector vibrates without anything in contact with the first contact detector and a state in which an object is in contact with the first contact detector and the vibration has attenuated are clearly distinguished, and a probability of false detection is low. Furthermore, according to the printer, an object can be detected regardless of light reflectance. Therefore, the above-described printer achieves more reliable detection of a recording medium and an obstacle.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1:
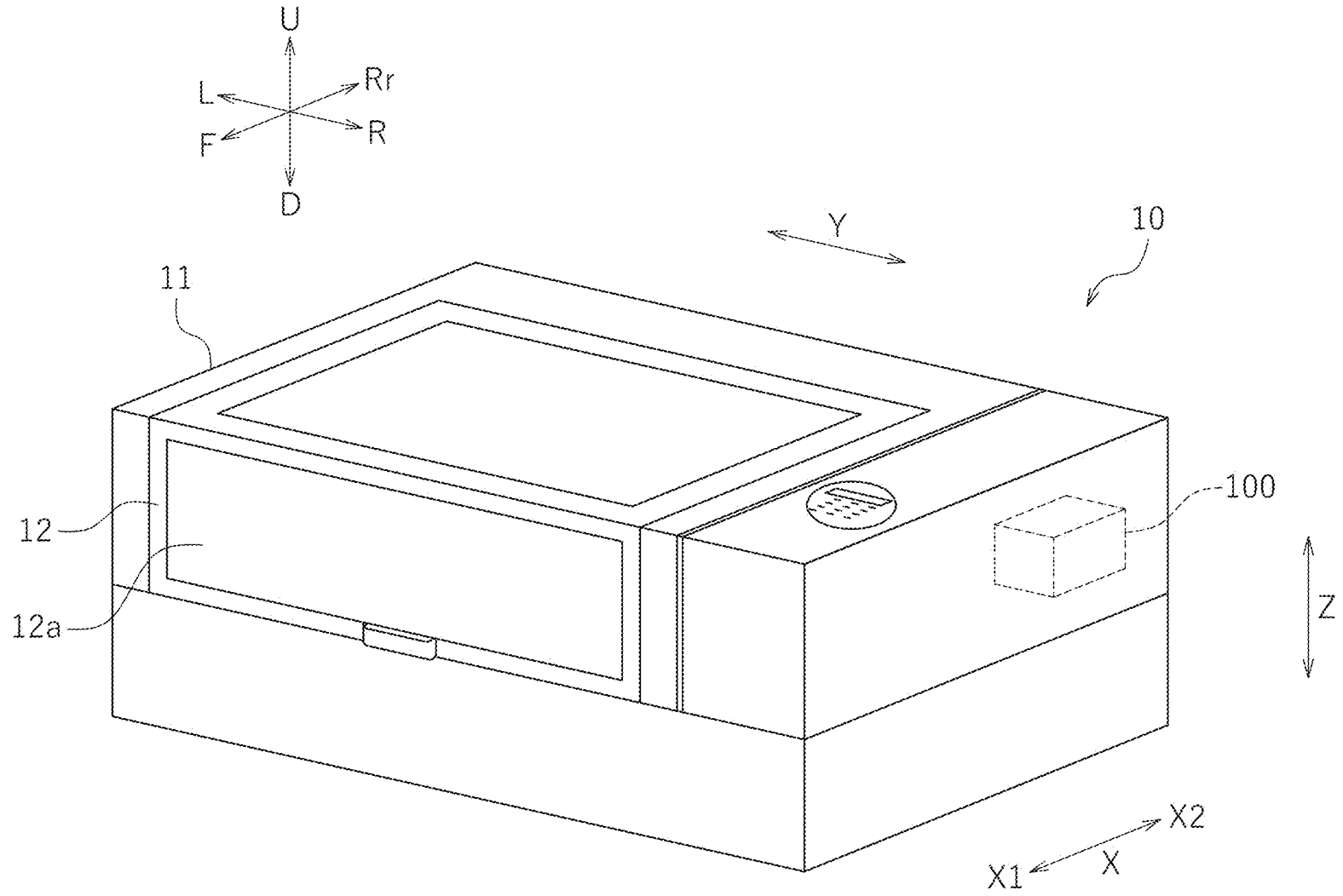
FIG. 1 is a perspective view of a printer according to a preferred embodiment of the present invention.

With reference to the attached drawings, preferred embodiments of the present invention will be described below. As a matter of course, preferred embodiments described herein are not intended to be particularly limiting the present invention. Members and portions that have the same function are denoted by the same reference character and redundant description will be omitted or simplified, as appropriate.

FIG. 1 is a perspective view of an ink jet printer (which will be hereinafter referred to as a printer) 10 according to a preferred embodiment. In the following description, unless specifically stated otherwise, when the printer 10 is viewed from front, a direction away from the printer 10 is a forward direction and a direction approaching the printer 10 is a rearward direction. Left, right, up, and down mean left, right, up, and down when the printer 10 is viewed from front, respectively. Reference symbols F, Rr, L, R, U, and D in the drawings indicate front, rear, left, right, up, and down, respectively. The reference symbol Y as used in the drawings denotes a main scanning direction. The main scanning direction Y is a left-right direction. The reference symbol X denotes a sub scanning direction. The sub scanning direction X is a front-rear direction. The reference symbol Z denotes an up-down direction. The main scanning direction Y, the sub scanning direction X, and the up-down direction Z are orthogonal to each other. Note that these directions are used herein merely for convenience of description, do not limit setting modes of the printer 10, and do not limit any of the preferred embodiments of the present invention.

In the present preferred embodiment, the printer 10 is an ink jet printer. In the present preferred embodiment, an "ink jet system" includes various known ink jet systems including various continuous methods, such as a binary deflection method, a continuous deflection method, or the like, and various on-demand methods, such as a thermal method, a piezoelectric method, or the like.

Figure 2:
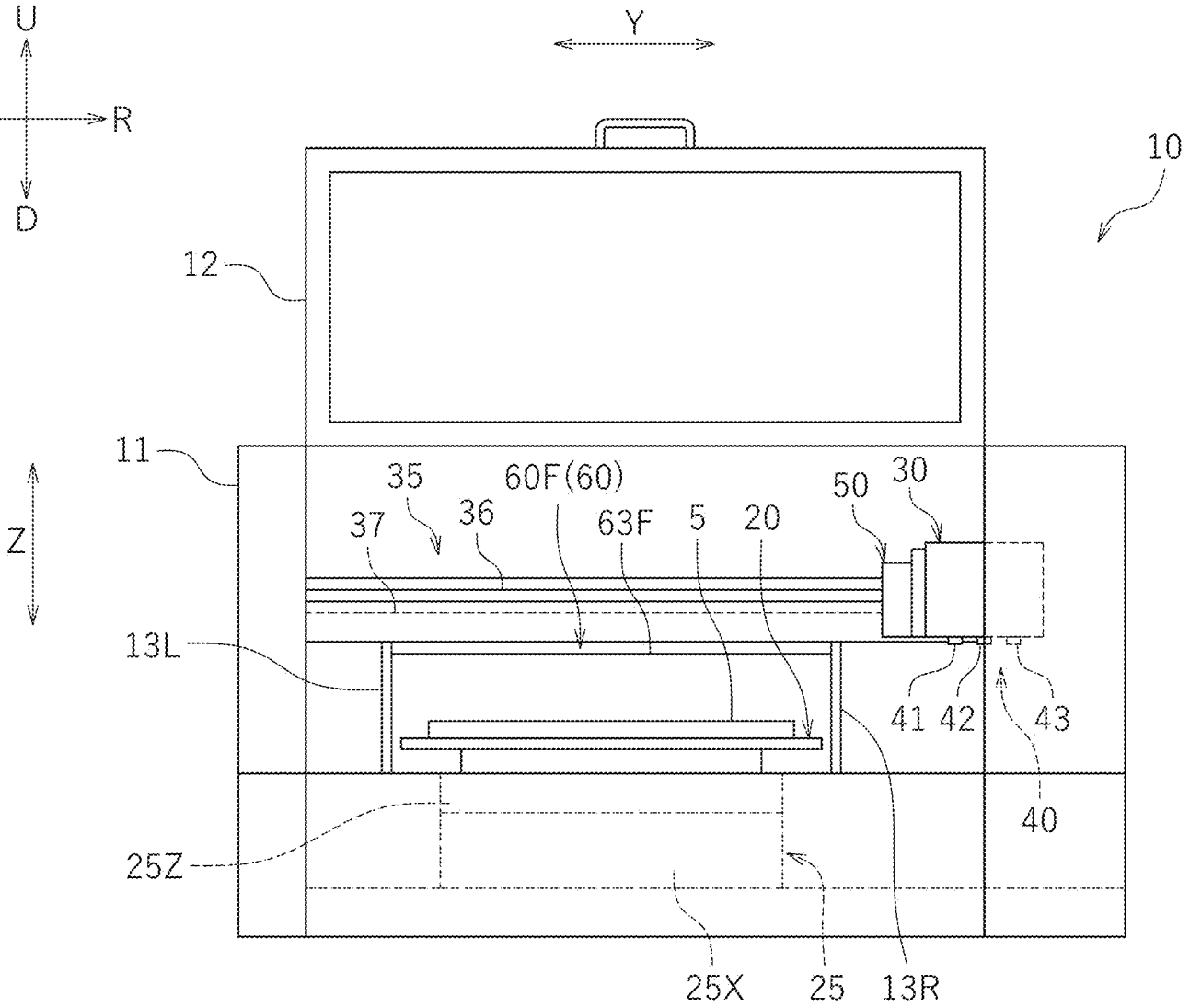
FIG. 2 is a front view schematically illustrating a printer in a state in which a front cover is opened.

As illustrated in FIG. 1, the printer 10 is formed into a box shape. In this preferred embodiment, the printer 10 includes a case 11 and a front cover 12. FIG. 2 is a front view of the printer 10 in a state in which the front cover 12 is opened. As illustrated in FIG. 2, an opening is provided in a front portion of the case 11. The front cover 12 is able to open and close the opening of the case 11. In this preferred embodiment, the front cover 12 is supported by the case 11 so as to be turnable about a rear end thereof as an axis. A window 12*a* is provided in the front cover 12. The window 12*a* is formed of, for example, a transparent acryl plate. A user is able to view an internal space of the case 11 through the window 12*a*.

As illustrated in FIG. 2, a flatbed 20, a bed mover 25, a carriage 30, a carriage mover 35, a recording head 40, a light irradiator 50, a contact detector 60, and a controller 100 (see FIG. 1) are provided in an internal space of the printer 10.

The flatbed 20 is a supporting table that supports a recording medium 5. The printer 10 according to this preferred embodiment is a so-called flatbed type printer. The flatbed 20 has a plate shape. The flatbed 20 extends in the main scanning direction Y and the sub scanning direction X. The flatbed 20 faces in the up-down direction Z. There is no particular limitation on a shape of the recording medium 5. The recording medium 5 may have various stereoscopic shapes, in addition to a plate shape. Also, there is no particular limitation on a material of the recording medium 5. The recording medium 5 may be formed of, for example, wood, metal, glass, paper, fabric, or the like. The flatbed 20 is disposed substantially in a center in the internal space of the case 11 in the main scanning direction Y.

The bed mover 25 is disposed below the flatbed 20. The bed mover 25 moves the flatbed 20 in the sub scanning direction X and the up-down direction Z. The flatbed 20 is supported by the bed mover 25 from below. The bed mover 25 includes a sub scanning direction mover 25X and an up-down direction mover 25Z. The up-down direction mover 25Z supports the flatbed 20 and moves the flatbed 20 in the up-down direction Z. The up-down direction mover 25Z is supported by the sub scanning direction mover 25X from below. The sub scanning direction mover 25X supports the up-down direction mover 25Z and moves the up-down direction mover 25Z in the sub scanning direction X. However, there is no limitation on a configuration of the bed mover 25. For example, an upper and lower positional relation of the sub scanning direction mover 25X and the up-down direction mover 25Z may be reversed.

Figure 3:
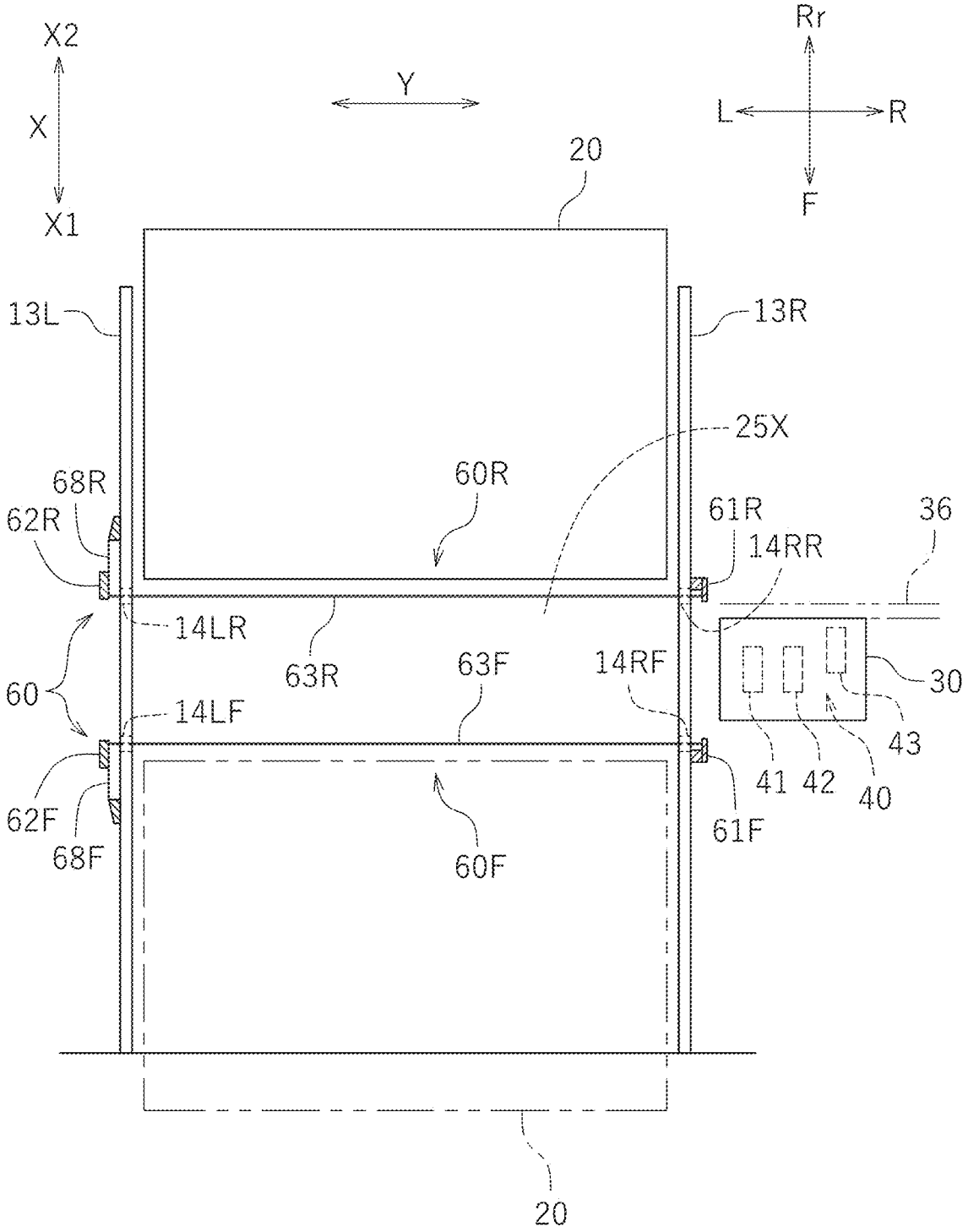
FIG. 3 is a plan view schematically illustrating a vicinity of a flatbed when viewed from above.
Figure 4:
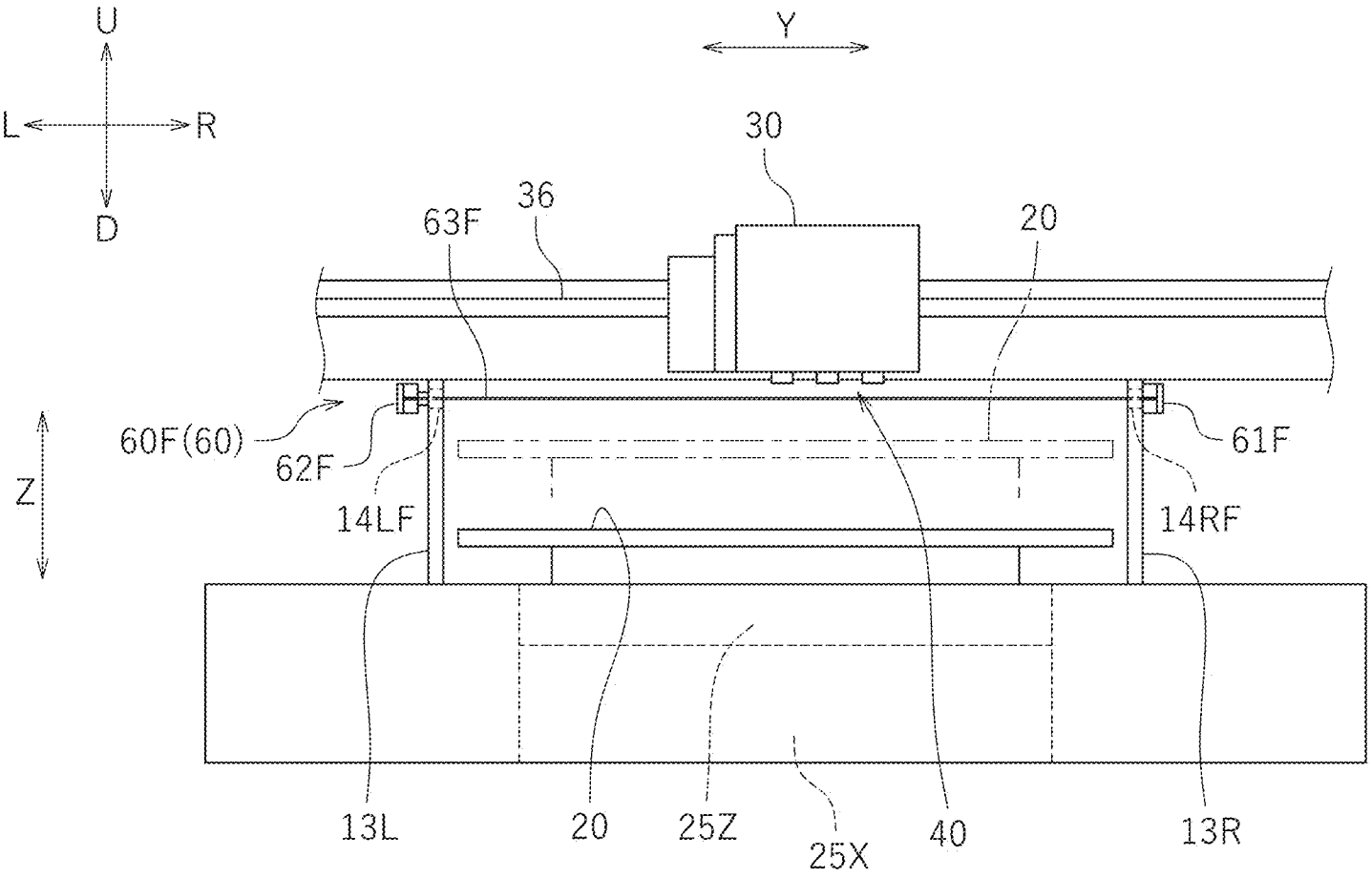
FIG. 4 is a front view schematically illustrating the vicinity of the flatbed.

FIG. 3 is a plan view schematically illustrating a vicinity of the flatbed 20 when viewed from above. FIG. 4 is a front view schematically illustrating the vicinity of the flatbed. As illustrated in FIG. 3, the sub scanning direction mover 25X is configured to move the flatbed 20 to a position more rearward than the carriage 30. In FIG. 3, the flatbed 20 indicated by a solid line illustrates the flatbed 20 in a state of being positioned rearmost. The sub scanning direction mover 25X is configured to also move the flatbed 20 to a position more forward than the carriage 30. In FIG. 3, the flatbed 20 indicated by a chain double-dashed line illustrates the flatbed 20 in a state of being positioned foremost. With a moving range of the flatbed 20 in the sub scanning direction X set in the above-described manner, the entire flatbed 20 can pass below the carriage 30 in the sub scanning direction X. The moving range of the flatbed 20 in the sub scanning direction X may be set such that an entire printable region set on the flatbed 20 can pass below the recording head 40.

As illustrated in FIG. 4, the up-down direction mover 25Z is configured to move the flatbed 20 between a position farther below the carriage 30 and a position slightly below the carriage 30. In FIG. 4, the flatbed 20 indicated by a solid line illustrates the flatbed 20 in a state of being positioned lowermost, and the flatbed 20 indicated by a chain double-dashed line illustrates the flatbed 20 in a state of being positioned uppermost.

The carriage 30 includes the recording head 40 and the light irradiator 50 mounted thereon. The carriage 30 is provided above the flatbed 20. The carriage 30 is moved by the carriage mover 35 in the main scanning direction Y. The carriage mover 35 includes a guide rail 36, a belt 37, left and right pullies (not illustrated), and a carriage motor 38 (see FIG. 8).

As illustrated in FIG. 2, the guide rail 36 extends in the main scanning direction Y. The carriage 30 is slidably engaged with the guide rail 36. The endless belt 37 is fixed to the carriage 30. The belt 37 is wound around the pullies (not illustrated) provided at right and left of the guide rail 36. The carriage motor 38 is attached to one of the pullies. When the carriage motor 38 is driven, the pullies rotate and the belt 37 runs. Accordingly, the carriage 30 moves along the guide rail 36 in the main scanning direction Y.

As illustrated in FIG. 2, the recording head 40 is provided on a lower surface of the carriage 30. The recording head 40 is provided above the flatbed 20. The recording head 40 is configured to eject ink toward the flatbed 20. The recording head 40 is opposed to the flatbed 20. The recording head 40 includes a plurality of ink heads 41 to 43. As illustrated in FIG. 3, each of the plurality of ink heads 41 to 43 extends in the sub scanning direction X. Each of the plurality of ink heads 41 to 43 includes a plurality of nozzles that eject ink toward the flatbed 20. In each of the plurality of ink heads 41 to 43, the plurality of nozzles are arranged in line in the sub scanning direction X.

In this preferred embodiment, the ink ejected from the nozzles of the recording head 40 is a photo curable ink. The photo curable ink is an ultraviolet curing ink which is cured by irradiation with an ultraviolet ray. There is no particular limitation on components, characteristics, or the like of the photo curable ink.

The light irradiator 50 is provided at a left side of the recording head 40. The light irradiator 50 irradiates the flatbed 20 with light that cures the photo curable ink. The light irradiator 50 includes light sources (not illustrated) constituted by, for example, a plurality of ultraviolet irradiation LEDs. A light irradiation port (not illustrated) that is opened downward and through which light generated by the light sources passes is provided in the light irradiator 50.

As illustrated in FIG. 3 and FIG. 4, a left side frame 13L and a right side frame 13R are provided at a left side and a right side of the flatbed 20, respectively. The left side frame 13L is formed in a flat plate shape and extends in the sub scanning direction X and the up-down direction Z. The right side frame 13R is formed in a flat plate shape and extends in the sub scanning direction X and the up-down direction Z. Each of the left side frame 13L and the right side frame 13R extends to a vicinity of a lower end of the guide rail 36 in the up-down direction Z.

As illustrated in FIG. 3, two through holes 14LF and 14LR arranged in line in the sub scanning direction X are provided in the left side frame 13L. The left rear through hole 14LR is disposed more rearward than the left forward through hole 14LF. Each of the left forward through hole 14LF and the left rear through hole 14LR passes through the left side frame 13L in the main scanning direction Y. As illustrated in FIG. 3, two through holes 14RF and 14RR arranged in line in the sub scanning direction X are provided in the right side frame 13R. The right rear through hole 14RR is disposed more rearward than the right forward through hole 14RF. Each of the right forward through hole 14RF and the right rear through hole 14RR passes through the right side frame 13R in the main scanning direction Y. The four through holes 14LF, 14LR, 14RF, and 14RR are holes through which wires 63F and 63R of the contact detector 60 described later pass.

As illustrated in FIG. 4, the four through holes 14LF, 14LR (not illustrated in FIG. 4 because the through hole 14LR is rearward of and is hidden by the through hole 14LF, see FIG. 3), 14RF, and 14RR (the same applies, see FIG. 3) are located at the same position in the up-down direction Z. Specifically, the four through holes 14LF, 14LR, 14RF, and 14RR are provided such that axis lines of the four through holes 14LF, 14LR, 14RF, and 14RR pass slightly below a lower surface of the recording head 40. There is no particular limitation on a distance between the axis lines of the four through holes 14LF, 14LR, 14RF, and 14RR and the lower surface of the recording head 40, but the distance may be preferably about 0.5 mm to about 1 mm, for example. Positions of the four through holes 14LF, 14LR, 14RF, and 14RR in the up-down direction Z are more upward than the flatbed 20 in a state of being positioned uppermost.

As illustrated in FIG. 3, the left forward through hole 14LF and the right forward through hole 14RF face each other in the main scanning direction Y. In other words, a position of the left forward through hole 14LF in the sub scanning direction X and a position of the right forward through hole 14RF in the sub scanning direction X are aligned. The left forward through hole 14LF and the right forward through hole 14RF are provided in a position more forward than the carriage 30 herein. However, the left forward through hole 14LF and the right forward through hole 14RF may be provided in a position more forward than the recording head 40 and more rearward than a front end of the carriage 30.

Similarly, the left rear through hole 14LR and the right rear through hole 14RR face each other in the main scanning direction Y. A position of the left rear through hole 14LR in the sub scanning direction X and a position of the right rear through hole 14RR in the sub scanning direction X are aligned. The left rear through hole 14LR and the right rear through hole 14RR are provided in a position more rearward than the carriage 30 herein. However, the left rear through hole 14LR and the right rear through hole 14RR may be provided in a position more rearward than the recording head 40 and more forward than a rear end of the carriage 30.

The contact detector 60 detects an obstacle that is likely to come into contact with the recording head 40. The contact detector 60 includes two wires as contact detectors and detects whether an object has come into contact with the wires. As illustrated in FIG. 3, the contact detector 60 includes a first contact detector 60R and a second contact detector 60F. The first contact detector 60R detects an obstacle approaching the recording head 40 from a rear side. The second contact detector 60F detects an obstacle approaching the recording head 40 from a forward side.

Figure 5:
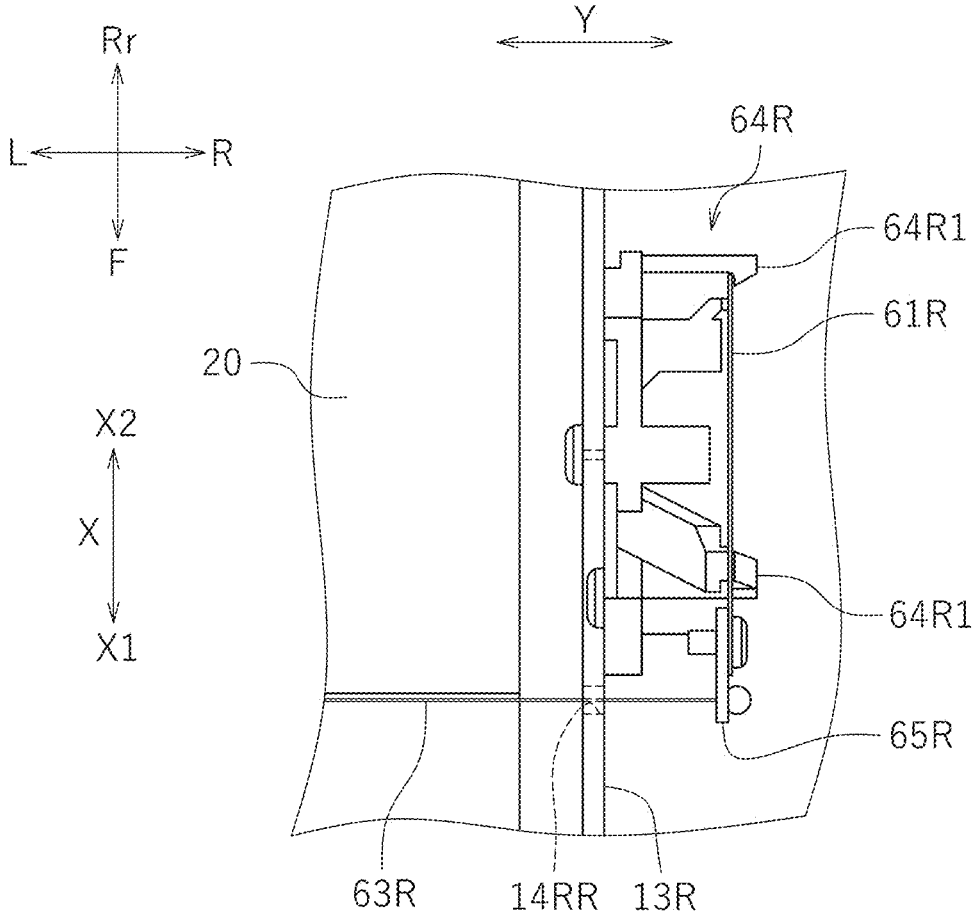
FIG. 5 is a plan view illustrating a vicinity of a first oscillator when viewed from above.

As illustrated in FIG. 3, the first contact detector 60R includes a first oscillator 61R, a first vibration detector 62R, and a first wire 63R. The first oscillator 61R is provided on a right surface of the right side frame 13R (a back surface of a surface of the right side frame 13R facing the flatbed 20). FIG. 5 is a plan view illustrating a vicinity of the first oscillator 61R when viewed from above. As illustrated in FIG. 5, the first oscillator 61R is fixed to the right side frame 13R via a sensor bracket 64R. The first oscillator 61R is an oscillation element including a piezoelectric element herein. The first oscillator 61R is coupled to a controller 100 and vibrates at a frequency corresponding to a frequency of an electrical signal applied by the controller 100.

Figure 6:
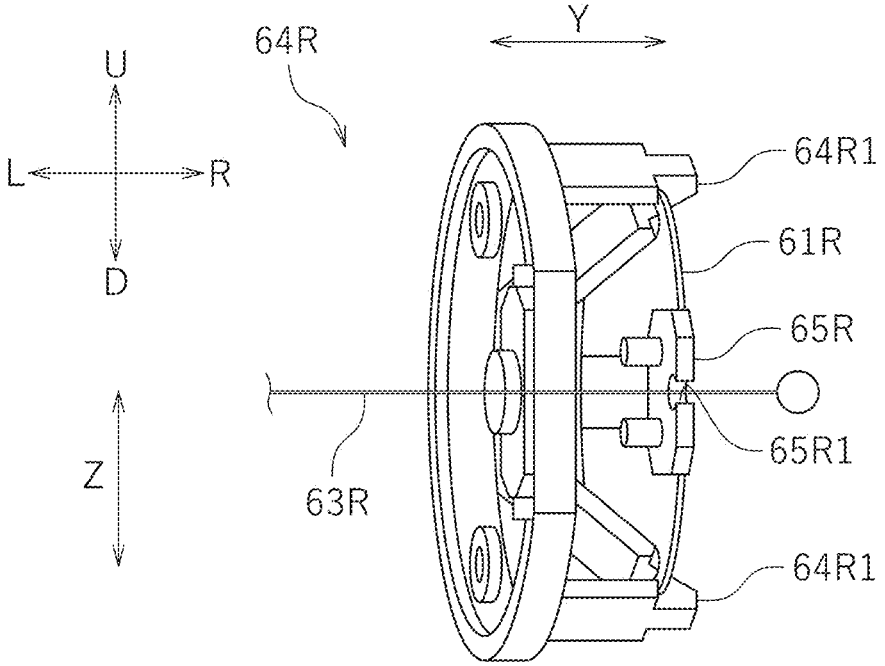
FIG. 6 is a perspective view of a sensor bracket.

FIG. 6 is a perspective view of the sensor bracket 64R. As illustrated in FIG. 6, the first oscillator 61R is supported by a plurality of gripping pawls 64R1 (also see FIG. 5) of the sensor bracket 64R so as to be separated from a main body of the sensor bracket 64R. The gripping pawls 64R1 support the first oscillator 61R so as not to hinder vibration of the first oscillator 61R. A wire engaging member 65R is coupled to the first oscillator 61R. A right end of the first wire 63R is engaged with the wire engaging member 65R. Specifically, the right end of the first wire 63R is provided to pass through an engaging groove 65R1 of the wire engaging member 65R and is engaged with a right surface of the wire engaging member 65R. The vibration of the first oscillator 61R is transferred to the first wire 63R via the wire engaging member 65R. According to the above-described configuration, the first oscillator 61R vibrates the first wire 63R.

The first wire 63R is inserted in the right rear through hole 14RR. The first wire 63R extends to a position located more leftward than the right side frame 13R through the right rear through hole 14RR and stretches above the flatbed 20. The first wire 63R is further inserted in the left rear through hole 14LR. A left end of the first wire 63R reaches a position leftward of the left side frame 13L through the left rear through hole 14LR.

As illustrated in FIG. 3, the first vibration detector 62R is provided more leftward than the left side frame 13L. The left end of the first wire 63R is engaged with the first vibration detector 62R via a wire engaging member 67R (see FIG. 7). The first vibration detector 62R is configured to detect vibration of the first wire 63R and transmit a signal corresponding to the detected vibration. The first vibration detector 62R is a vibration sensor including a piezoelectric element. The piezoelectric element generates a voltage signal corresponding to an applied pressure. Therefore, when vibration (periodic pressure fluctuations) is applied, the piezoelectric element generates a signal corresponding to intensity and frequency of the vibration. In this preferred embodiment, the first vibration detector 62R is the same as the first oscillator 61R. However, the first vibration detector 62R may not be the same as the first oscillator 61R.

Figure 7:
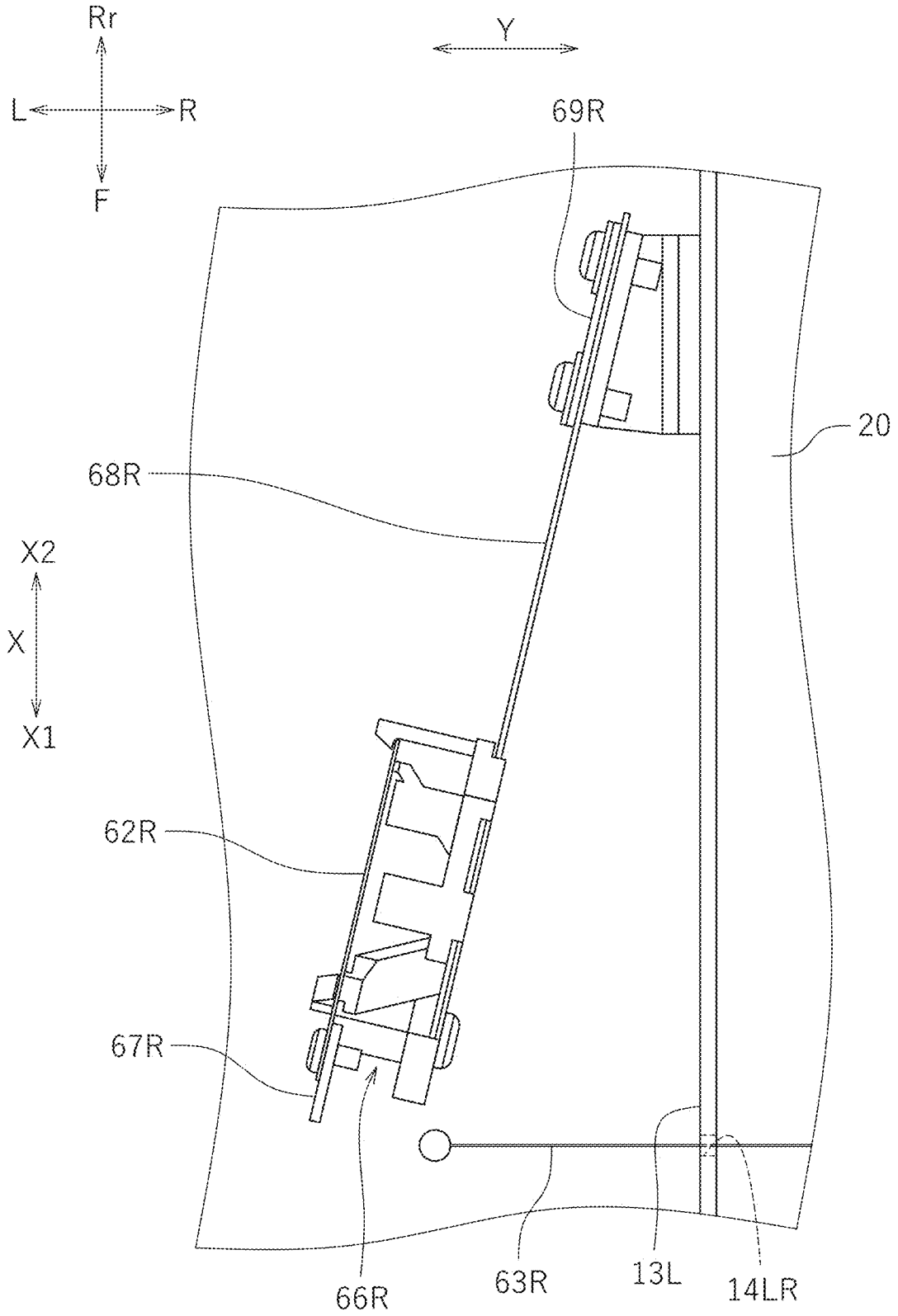
FIG. 7 is a plan view illustrating a vicinity of a first vibration detector when viewed from above.

FIG. 7 is a plan view schematically illustrating a vicinity of the first vibration detector 62R when viewed from above. Provided that FIG. 7 illustrates the first vibration detector 62R in a state in which the first wire 63R has been removed. As illustrated in FIG. 7, the first vibration detector 62R is supported by a first plate spring 68R via a sensor bracket 66R. The sensor bracket 66R is fixed to a front end of the first plate spring 68R. In this preferred embodiment, the sensor bracket 66R that supports the first vibration detector 62R is the same as the sensor bracket 64R that supports the first oscillator 61R. The wire engaging member 67R coupled to the first vibration detector 62R is the same as the wire engaging member 65R coupled to the first oscillator 61R. However, the sensor bracket that supports the first vibration detector 62R may not be the same as the sensor bracket that supports the first oscillator 61R, and the wire engaging member coupled to the first vibration detector 62R may not be the same as the wire engaging member coupled to the first oscillator 61R.

The first plate spring 68R is fixed to the left side frame 13L via a bracket 69R. The bracket 69R is fixed to a left surface of the left side frame 13L (a back surface of a surface of the left side frame 13L facing the flatbed 20). Herein, the bracket 69R is provided more rearward than the left rear through hole 14LR. A rear end of the first plate spring 68R is supported by the bracket 69R. The first plate spring 68R extends diagonally forward to left from the bracket 69R. The first plate spring 68R is spaced farther from the left side frame 13L as proceeding from the rear end supported by the bracket 69R to the front end which the sensor bracket 66R is fixed to. The first plate spring 68R has a flat plate shape when no force is applied thereto and has a predetermined width in the up-down direction. The first plate spring 68R is configured so as to be bent in the main scanning direction Y when a force is applied in the main scanning direction Y.

The first wire 63R has one end (left end herein) engaged with the first plate spring 68R in a deformed state and is pulled by a restoring force of the first plate spring 68R (see FIG. 3). Herein, the first wire 63R is engaged with the first plate spring 68R so as to bend the first plate spring 68R rightward. The first wire 63R is pulled leftward by the first plate spring 68R. A tension of the first wire 63R is kept at a predetermined level by the restoring force of the first plate spring 68R.

An elastic body that gives a tension to the first wire 63R is not limited to a plate spring. The elastic body may be, for example, a coil spring or the like. However, by using a plate spring as the elastic body, a length of the elastic body in the main scanning direction Y can be reduced. In a case where the elastic body is a coil spring, the coil spring is disposed such that an axis line thereof is directed in the main scanning direction Y, unless a mechanism that changes a direction of the force is provided. Therefore, when a coil spring is used as the elastic body, the length of the elastic body in the main scanning direction Y is likely to be large. By using a plate spring as the elastic body, the length of the elastic body can be easily reduced as compared to a case where the elastic body is a coil spring.

The elastic body may not be coupled to an end portion of the wire located closer to the vibration detector, and may be coupled to, for example, an end portion of the wire located closer to the oscillator. Furthermore, a position where the elastic body is provided is not limited between the side frame and the vibration detector (or the oscillator). For example, the elastic body may be provided between the vibration detector (or the oscillator) and the wire. The elastic body is engaged with the wire directly or via some other member and may be configured to pull the wire with a restoring force thereof. There is no particular limitation on an arrangement or a type of the elastic body.

The first wire 63R is provided to stretch between the first oscillator 61R and the first vibration detector 62R. The first wire 63R extends in the main scanning direction Y. The first wire 63R is inserted through the left rear through hole 14LR of the left side frame 13L and the right rear through hole 14RR of the right side frame 13R. Therefore, as illustrated in FIG. 4, the first wire 63R is provided in a position that is above the flatbed 20 and is lower than the recording head 40 to stretch in parallel or substantially in parallel to the flatbed 20. There is no particular limitation on a distance between the recording head 40 and the first wire 63R in the up-down direction, but preferably, may be about 0.5 mm to about 1 mm, for example. Moreover, as illustrated in FIG. 3, the first wire 63R is provided more rearward than the recording head 40.

There is no particular limitation on a material, a thickness, or the like of the first wire 63R. The first wire 63R may be, for example, a wire formed of carbon steel, which is so called piano wire. The first wire 63R may be some other metal wire, such as, for example, a stainless steel or copper wire. The first wire 63R may be a wire formed of a resin. Preferably, the first wire 63R may be formed of a material that is chemically resistant to ink and ultraviolet rays. A diameter of the first wire 63R is preferably about 0.1 mm or more and about 0.5 mm or less, for example.

The second contact detector 60F is configured similarly to the first contact detector 60R. As illustrated in FIG. 3, the second contact detector 60F includes a second wire 63F, a second oscillator 61F that vibrates the second wire 63F, a second vibration detector 62F that detects vibration of the second wire 63F and transmits a signal corresponding to the detected vibration, and a second plate spring 68F that pulls the second wire 63F with a restoring force thereof. The second wire 63F is inserted through the left forward through hole 14LF and the right forward through hole 14RF. The second wire 63F is provided in an opposite side to a side at which the first wire 63R is provided (more forward than the recording head 40 herein) with the recording head 40 interposed therebetween. The second wire 63F is provided in the same position as the first wire 63R in the up-down direction Z.

An AC electrical signal having designated frequency and amplitude is applied to each of the first oscillator 61R and the second oscillator 61F. Accordingly, each of the first oscillator 61R and the second oscillator 61F generates vibration having frequency and amplitude corresponding to the electrical signal. It is hereinafter also expressed as "vibration has high intensity" that the amplitude of vibration is large. Each of the first vibration detector 62R and the second vibration detector 62F generates an electrical signal having frequency and amplitude corresponding to frequency and amplitude of vibration received from a corresponding one of the first wire 63R and the second wire 63F. The first vibration detector 62R can detect at least fluctuations of the frequency and amplitude (intensity) of the vibration of the first wire 63R. The second vibration detector 62F can detect at least fluctuations of the frequency and amplitude (intensity) of the vibration of the second wire 63F.

Figure 8:
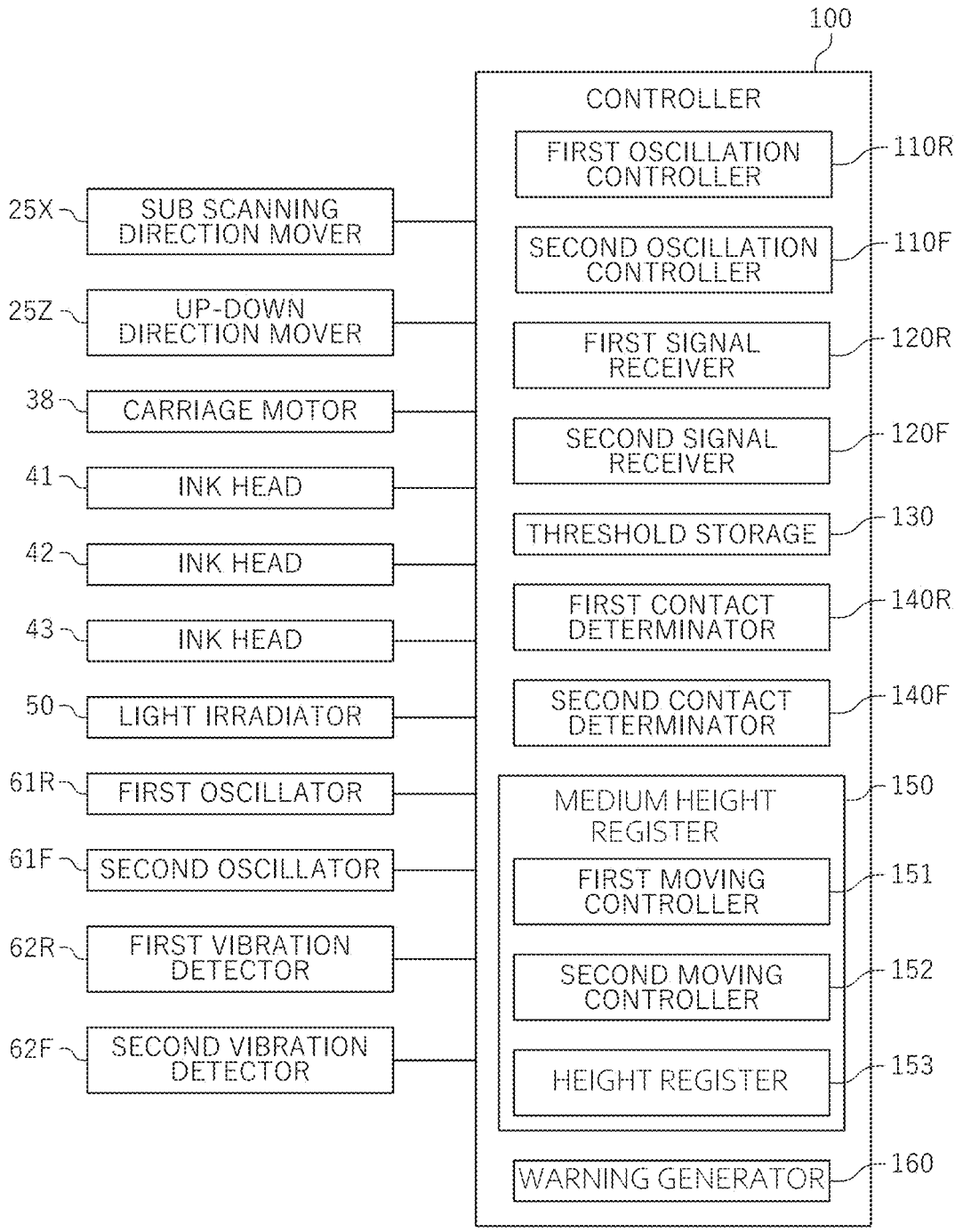
FIG. 8 is a block diagram of a printer.

FIG. 8 is a block diagram of the printer 10. As illustrated in FIG. 8, the controller 100 is electrically coupled to the sub scanning direction mover 25X, the up-down direction mover 25Z, the carriage motor 38, the plurality of ink heads 41 to 43, the light irradiator 50, the first oscillator 61R, and the second oscillator 61F and controls operations thereof. The controller 100 is electrically coupled to the first vibration detector 62R and the second vibration detector 62F and receives signals transmitted by the first vibration detector 62R and the second vibration detector 62F. The controller 100 is, for example, a computer coupled to the printer 10 and may include a central processing unit (which will be hereinafter referred to as a CPU), ROM in which a program executed by the CPU or the like is stored, and RAM, or the like. Each element of the controller 100 may be configured by software and may be configured by hardware. Each element of the controller 100 may be a processor and may be a circuit. There is no particular limitation on a configuration of the controller 100.

As illustrated in FIG. 8, the controller 100 is configured or programmed to include a first oscillation controller 110R, a second oscillation controller 110F, a first signal receiver 120R, a second signal receiver 120F, a threshold storage 130, a first contact determinator 140R, a second contact determinator 140F, a medium height register 150, and a warning generator 160. The controller 100 may include some other controller, such as, for example, a controller that controls a printing operation or the like, but description and illustration of some other controller will be omitted.

The first oscillation controller 110R vibrates the first oscillator 61R by transmitting a signal having a predetermined frequency and amplitude to the first oscillator 61R. Thus, the first wire 63R vibrates at the predetermined frequency and amplitude. The second oscillation controller 110F vibrates the second oscillator 61F by transmitting a signal having a predetermined frequency and amplitude to the second oscillator 61F. Thus, the second wire 63F vibrates at the predetermined frequency and amplitude. In this preferred embodiment, oscillation frequencies of the first oscillator 61R and the second oscillator 61F are set to be in a high frequency region in a different frequency band from that of shake of the printer 10 or the like. Each of the oscillation frequencies of the first oscillator 61R and the second oscillator 61F is preferably, for example, about 10 kHz or more and about 100 kHz or less. However, there is no particular limitation on the oscillation frequencies of the first oscillator 61R and the second oscillator 61F. The oscillation frequency of the first oscillator 61R and the oscillation frequency of the second oscillator 61F may be the same and may be different from each other.

The first signal receiver 120R is configured to receive the signal from the first vibration detector 62R. The printer 10 grasps the frequency and amplitude (intensity) of the vibration of the first wire 63R by reception of the signal from the first vibration detector 62R by the first signal receiver 120R. The second signal receiver 120F is configured to receive the signal from the second vibration detector 62F. The printer 10 grasps the frequency and amplitude (intensity) of the vibration of the second wire 63F by reception of the signal from the second vibration detector 62F by the second signal receiver 120F.

The threshold storage 130 stores thresholds related to the vibrations of the first wire 63R and the second wire 63F. A first threshold related to the first wire 63R is a ratio to the intensity of vibration detected by the first vibration detector 62R in a state in which an object is not in contact therewith. The threshold is set, for example, to a value of about 50% or the like. A second threshold related to the second wire 63F is a ratio to the intensity of vibration detected by the second vibration detector 62F in a state in which an object is not in contact therewith herein. However, each of the first threshold and the second threshold may be, for example, an absolute value of the intensity of the vibration and the value thereof is not limited. The first threshold and the second threshold may be the same value and may be different values.

When the vibration detected by the first vibration detector 62R is the first threshold or less, the first contact determinator 140R determines that an object has come into contact with the first wire 63R. When the first contact determinator 140R determines that an object has come into contact with the first wire 63R, the first contact determinator 140R transmits a first detection signal. When the vibration detected by the second vibration detector 62F is the second threshold or less, the second contact determinator 140F determines that an object has come into contact with the second wire 63F. When the second contact determinator 140F determines that an object has come into contact with the second wire 63F, the second contact determinator 140F transmits a second detection signal.

In the medium height register 150, in order to prevent the recording medium 5 from coming into contact with the recording head 40, a height of the recording medium 5 (actually, a height of the flatbed 20 in a state in which the recording medium 5 is placed thereon) is registered. The height of the flatbed 20 registered in the medium height register 150 is a height at which the recording medium 5 placed on the flatbed 20 is positioned at a slightly lower level than that of the recording head 40. The position of the flatbed 20 will be hereinafter also referred to as an "upper limit position." The printer 10 is configured to set the upper limit position before printing such that the flatbed 20 is not positioned at a higher level than the upper limit position during printing.

As illustrated in FIG. 8, the medium height register 150 includes a first moving controller 151, a second moving controller 152, and a height register 153. The first moving controller 151 is configured to control the up-down direction mover 25Z to move the flatbed 20 supporting the recording medium 5 upward. More specifically, the first moving controller 151 controls the up-down direction mover 25Z to intermittently move the flatbed 20 supporting the recording medium 5 upward from a lowest position. A raising distance by which the flatbed 20 is raised for one time is preferably about 5 mm to about 10 mm, for example. However, there is no particular limitation on the raising distance of the flatbed 20 for one time.

Each time the flatbed 20 is moved upward by control performed by the first moving controller 151, the second moving controller 152 controls the sub scanning direction mover 25X to move the flatbed 20 in one direction or the other direction of the sub scanning direction X. As illustrated in FIG. 3, a forward direction of the sub scanning direction X will be hereinafter also referred to as an X1 direction and a rearward direction thereof will be hereinafter also referred to as an X2 direction. By controls performed by the first moving controller 151 and the second moving controller 152, the flatbed 20 repeats a set of "raising," "moving in the X1 direction or the X2 direction," "raising," and "moving in the X2 direction or the X1 direction." However, when the contact detector 60 detects a contact of an object with the first wire 63R or the second wire 63F, an operation is terminated in middle of the set. The operation of the flatbed 20 will be described later.

The height register 153 resisters the upper limit position of the flatbed 20, based on a position of the flatbed 20 in the up-down direction when the first contact determinator 140R or the second contact determinator 140F determines that an object has come into contact with the first wire 63R or the second wire 63F, in other words, when the first contact determinator 140R or the second contact determinator 140F transmits a detection signal. This registration operation will be also described later.

The warning generator 160 is configured to give a warning when the first contact determinator 140R or the second contact determinator 140F determines that an object has come into contact with the first wire 63R or the second wire 63F while the recording medium 5 moves in the sub scanning direction X (herein, while the flatbed 20 supporting the recording medium 5 moves in the sub scanning direction X). This warning warns that there is an obstacle that is likely to come into contact with the recording head 40. In this preferred embodiment, when a warning is given, movements of the flatbed 20 and the carriage 30 are stopped.

Figure 9:
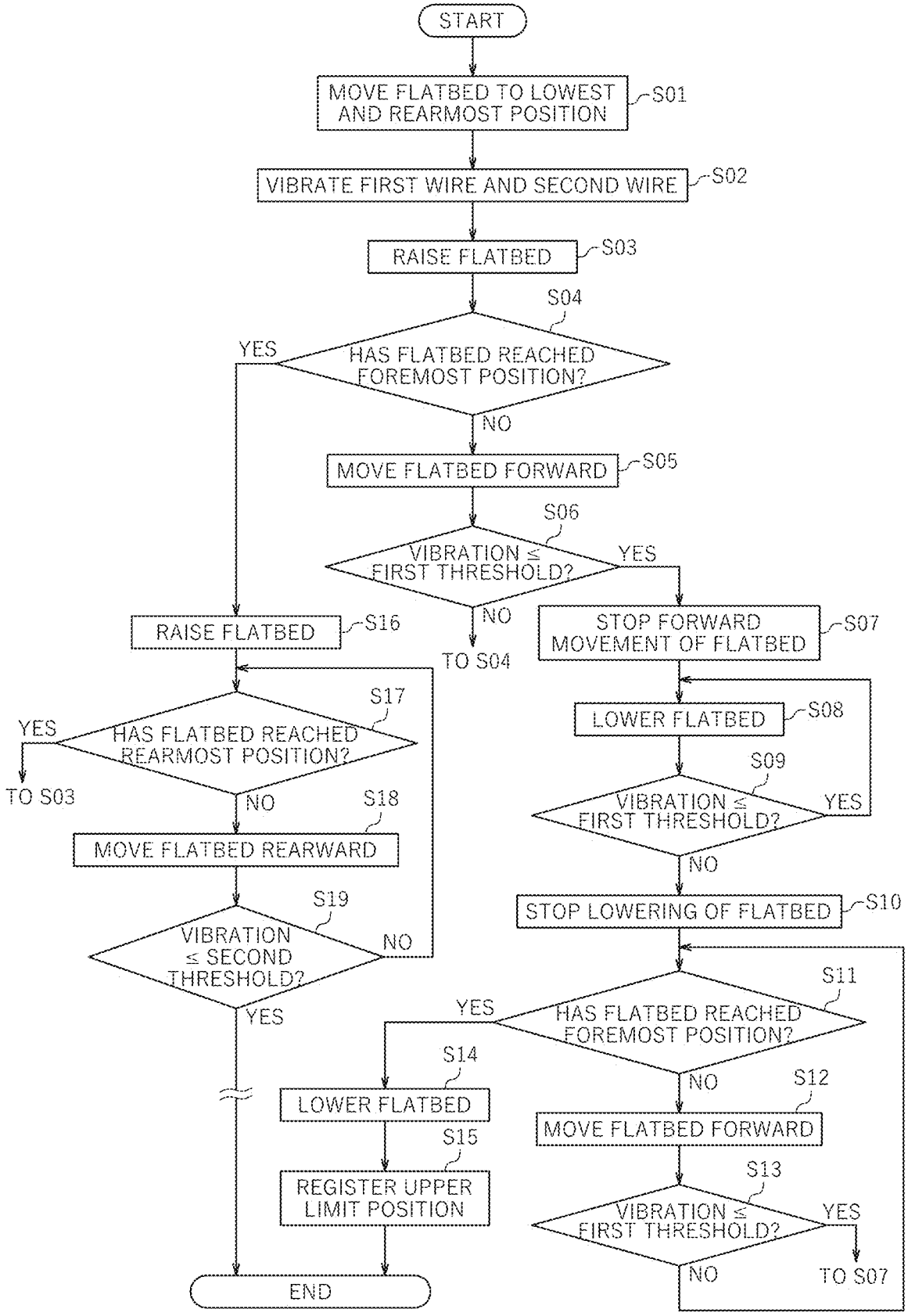
FIG. 9 is a flowchart of a process of registering an upper limit position of the flatbed.

A registration process of registering the upper limit position of the flatbed 20 and a warning process will be described below. FIG. 9 is a flowchart of a process of registering the upper limit position of the flatbed 20. As illustrated in FIG. 9, in Step S01 of the process of registering the upper limit position of the flatbed 20, the flatbed 20 is lowered to a lowest position and is further moved to a rearmost position. However, the flatbed 20 may be moved to a forwardmost position. The recording medium 5 is placed on the flatbed 20 before Step S01, although this step is not illustrated because the step is not an operation of the printer 10. In Step S02, each of the first oscillator 61R and the second oscillator 61F vibrates a corresponding one of the first wire 63R and the second wire 63F at a high frequency. Step S02 may be performed at any time before Step S03. In Step S03, the flatbed 20 is raised by a predetermined distance, that is, for example, about 5 mm.

In subsequent Steps S04 and S05, the sub scanning direction mover 25X is driven to move the flatbed 20 forward (in the X1 direction). In Step S04, it is determined whether the flatbed 20 has reached to a forwardmost position and, if the flatbed 20 has not reached the forwardmost position (if a result of Step S04 is NO), forward movement of the flatbed 20 is continued in Step S05. If the flatbed 20 has reached the forwardmost position (if the result of Step S04 is YES), forward movement of the flatbed 20 is stopped by not selecting forward movement of the flatbed 20 in Step S05.

In Step S06 subsequent to Step S05, it is determined whether an intensity of vibration detected by the first vibration detector 62R is the first threshold or less. If the intensity of the vibration detected by the first vibration detector 62R is the first threshold or less (if a result of Step S06 is YES), it is determined that the recording medium 5 has come into contact with the first wire 63R, and forward movement of the flatbed 20 is stopped in Step S07.

When the recording medium 5 or some other object has come into contact with the first wire 63R, the vibration of the first wire 63R attenuates. As a result, the vibration detected by the first vibration detector 62R attenuates. By setting a proper threshold (the first threshold) for attenuation of the vibration, whether the recording medium 5 and some other object has come into contact with the first wire 63R can be determined. The upper limit position of the flatbed 20 is determined, based on the position of the flatbed 20 in the up-down direction at a time point where the recording medium 5 has come into contact with the first wire 63R in Step S06, in Steps S07 to S15 thereafter. Herein, the upper limit position is the height of the flatbed 20 during printing.

In subsequent Step S08, the flatbed 20 is lowered at low speed. In Step S08, the flatbed 20 may be intermittently lowered by a short distance (for example, about 0.1 mm) each time. In Step S09, it is continuously determined whether the vibration of the first wire 63R is the first threshold or less. When the vibration of the first wire 63R is the first threshold or less (when a result of Step S09 is YES), lowering of the flatbed 20 in Step S08 is continued and determination of Step S09 is repeated. When the vibration of the first wire 63R exceeds the first threshold (when the result of Step S09 is changed to NO), lowering of the flatbed 20 is stopped in Step S10. At this time, it is determined that the recording medium 5 is not in contact with the first wire 63R. By the above-described control, a height of a portion of the recording medium 5 in contact with the first wire 63R in Step S06 is obtained. The above-described phrase means that "the position of the flatbed 20 in the up-down direction when an upper end of the portion of the recording medium 5 in contact with the first wire 63R in Step S06 is at the same height as that of the first wire 63R is obtained." The phrase will be hereinafter also expressed as "the height of the recording medium 5 is obtained" or the like.

In Steps S11 and S12, the flatbed 20 is moved forward (in the X1 direction) again. In Step S11, it is determined whether the flatbed 20 has reached the forwardmost position and, if the flatbed 20 has not reached the forwardmost position (if a result of Step S11 is NO), forward movement of the flatbed 20 is continued in Step S12. If the flatbed 20 has reached the forwardmost position (if the result of Step S11 is YES), forward movement of the flatbed 20 is stopped (forward movement of the flatbed 20 in Step S12 is not selected).

In Step S13 subsequent to Step S12, it is determined again whether the vibration of the first wire 63R is the first threshold or less. When the vibration of the first wire 63R exceeds the first threshold (if a result of Step S13 is NO), it is determined that the recording medium 5 is not in contact with the first wire 63R. In that case, forward movements of the flatbed 20 in Steps S11 and S12 are continued. Also, determination in Step S13 is repeated. If the vibration of the first wire 63R is the first threshold or less (if the result of Step S13 is YES), it is determined that some other portion of the recording medium 5 than the portion of thereof in contact with the first wire 63R in Step S06 has come into contact with the first wire 63R. In that case, the process returns to Step S07 and movement of the flatbed 20 in the X1 direction is stopped. Thereafter, Steps S08 to S13 are repeated.

When the flatbed 20 has reached the forwardmost position (when the result of Step S11 has become YES) while Steps S07 to S13 are repeated, forward movement of the flatbed 20 is stopped (forward movement of the flatbed 20 in Step S12 is not selected). At a time point where the result of Step S11 has become YES, a height of a highest portion of the recording medium 5 is determined. The position of the flatbed 20 in the up-down direction at the time point where the result of Step S11 has become YES corresponds to the highest portion of the recording medium 5. In this preferred embodiment, the flatbed 20 is lowered by a predetermined distance, that is, for example, about 1 mm, in subsequent Step S14. However, the distance by which the flatbed 20 is lowered in Step S14 is not limited. In Step S15, the position of the flatbed 20 after Step S14 is registered as the upper limit position.

On the other hand, in Steps S04 to S06, if the flatbed 20 has reached the forwardmost position while the recording medium 5 is not in contact with the first wire 63R (if the result of Step S04 is YES), forward movement of the flatbed 20 in Step S05 is not selected and the forward movement of the flatbed 20 is stopped. In subsequent Step S16, the flatbed 20 is raised by a predetermined distance, that is, for example, about 5 mm.

In subsequent Steps S17 and S18, the sub scanning direction mover 25X is driven to move the flatbed 20 rearward (in the X2 direction). Steps S17 and S18 are similar to Steps S04 and S05 except for the moving direction of the flatbed 20.

In Step S19, it is determined whether an intensity of vibration detected by the second vibration detector 62F is the second threshold or less. In other words, it is determined whether the recording medium 5 comes into contact with the second wire 63F. Although not illustrated, a process of registering the upper limit position while the flatbed 20 is moved rearward is similar to the process of registering the upper limit position while the flatbed 20 is moved forward. In Steps S17 to S19, if the flatbed 20 has reached the rearmost position while the recording medium 5 is not in contact with the second wire 63F (if a result of Step S17 is YES), rearward movement of the flatbed 20 is stopped and the process returns to Step S03. The above-described process is repeated until the upper limit position of the flatbed 20 is registered. In the above-described manner, the upper limit of the flatbed 20 based on detection of the contact detector 60 is registered.

The above-described process is merely a preferred example and the present invention is not limited thereto. For example, in the registration process of registering the upper limit position, the flatbed 20 may be raised only by a distance smaller than a clearance between the first wire 63R or the second wire 63F and the recording head 40 each time. In that case, the position of the flatbed 20 to which the flatbed 20 has downwardly moved from the position thereof when the recording medium 5 has come into contact with the first wire 63R or the second wire 63F for the first time may be registered as the upper limit position.

For example, if the upper limit position of the flatbed 20 is set in the above-described manner, normally, the recording medium 5 or some other object does not come into contact with the recording head 40 during printing. However, in a case where an unexpected situation, for example, where the recording medium 5 is turned up or the like, occurs, the recording medium 5 or some other object is likely to come into contact with the recording head 40 during printing in some cases. Therefore, the printer 10 according to this preferred embodiment is configured to monitor whether vibrations detected by the first vibration detector 62R and the second vibration detector 62F have attenuated to the first threshold or less and the second threshold or less, respectively, at all times while the flatbed 20 is moved in the sub scanning direction X. If, while the flatbed 20 is moved in the sub scanning direction X, the vibration detected by the first vibration detector 62R has attenuated to the first threshold or less or if the vibration detected by the second vibration detector 62F has attenuated to the second threshold or less, the printer 10 gives a warning and stops the flatbed 20. Thus, a contact of an object with the recording head 40 can be avoided.

As described above, the printer 10 according to this preferred embodiment includes the first wire 63R provided at a position that is above the flatbed 20 and is lower than the recording head 40, the first oscillator 61R that vibrates the first wire 63R, and the first vibration detector 62R that detects the vibration of the first wire 63R and is configured to determine that an object has come into contact with the first wire 63R when the vibration detected by the first vibration detector 62R is the set first threshold or less. According to the printer 10 described above, the recording medium 5 or some other obstacle can be detected more reliably than in known technologies for the following reason.

A known printer of one example includes a plate-like body that swings as a detection member that detects existence of a recording medium or some other obstacle, for example, as disclosed in Japanese Laid-open Patent Publication No. 2013-001004. In the printer, when the recording medium has come into contact with the detection member while a table is moved in the front-rear direction, the detection member rotates. By detecting a rotation of the detection member by a sensor, the printer detects the existence of the recording medium or some other obstacle located at a height equal to or higher than that of the detection member.

In the above-described known printer, regarding detection of the existence of the recording medium or some other obstacle, for example, there are some problems as follows. A height detection mechanism that detects a height of an obstacle, as disclosed in Japanese Laid-open Patent Publication No. 2013-001004, cannot detect a contact with the obstacle unless a detection member leans by a predetermined angle. Therefore, in the known printer, detection accuracy for a position of an obstacle in an up-down direction is not so high. However, when an angle at which the sensor reacts is reduced in order to increase detection accuracy, a probability of false detection is increased. Particularly, the printer is shaken by running of a carriage or the like in some cases. In such a case, it is likely that the detection member swings and a false detection occurs.

On the other hand, the printer 10 according to this preferred embodiment spontaneously applies vibration to the first wire 63R as a contact detector. Therefore, a state in which the first wire 63R vibrates without anything in contact with the first wire 63R and a state in which an object is in contact with the first wire 63R and the vibration has attenuated can be clearly distinguished. Therefore, there is a low probability of false detection. Accordingly, according to the printer 10 described above, before the recording medium 5 or some other obstacle comes into contact with the recording head 40, the recording medium 5 or some other obstacle can be detected more reliably. Moreover, the contact detector 60 according to this preferred embodiment can detect a contact of an object, if the object only comes into contact with the first wire 63R. Thus, detection accuracy in the up-down direction of the printer 10 according to this preferred embodiment is high.

Moreover, for example, in the printer disclosed in Japanese Laid-open Patent Publication No. 2013-001004, there is a tendency that, when a size of a flatbed increases, a size of the detection device including the detection member increases, and particularly, cost increases. On the other hand, in the printer 10 according to this preferred embodiment, a contact detector may be basically a member that can transfer vibration and a mechanism that swings or the like is not needed. Therefore, in the printer 10 according to this preferred embodiment, even when a size of the flatbed is increased, only the length of the contact detector is increased. Therefore, an increase in cost can be avoided. As described above, the contact detector may be basically a member that can transfer vibration, and therefore, may not be a wire. The contact detector may be, for example, a rod-like member or the like.

In a known printer according to another example, for example, as disclosed in Japanese Laid-open Patent Publication No. 2010-111091, existence of an obstacle is detected by an optical sensor. However, the printer has a problem in which it is difficult to detect an obstacle, such as a transparent recording medium or the like, having a low light reflectance. On the other hand, in the printer 10 according to this preferred embodiment, an obstacle is detected by contact, and therefore, even an obstacle having a low light reflectance can be detected without any problem.

Furthermore, in a printer including an optical sensor, accuracy in a direction of an optical axis of a luminous body or a sensor is required. Therefore, it requires a time or a cost (or both a time and a cost) to adjust the direction of the optical axis of the luminous body or the sensor in many cases. Moreover, the luminous body or the optical sensor, such as a laser luminous body or the like, itself is expensive in many cases. On the other hand, the printer 10 according to this preferred embodiment detects existence of the recording medium 5 or some other obstacle that is likely to come into contact with the recording head 40 by measuring vibration (specifically, an intensity of vibration) of the first wire 63R as the contact detector. Therefore, it is not necessary to use an expensive luminous body or optical sensor, and cost can be reduced. Moreover, in the printer 10 according to this preferred embodiment, unlike a printer including an optical sensor, it is not required to adjust a direction of an optical axis of a luminous body or an optical sensor with high accuracy. Therefore, the printer 10 according to this preferred embodiment can be more easily set.

The foregoing applies to setting of the second wire 63F provided farther in the X1 direction (forward) than the recording head 40, the second oscillator 61F that vibrates the second wire 63F, and the second vibration detector 62F that detects the vibration of the second wire 63F. Moreover, according to the above-described configuration, even when an obstacle approaches the recording head 40 either from the X1 direction or from the X2 direction, the obstacle can be detected. Therefore, the recording head 40 can be more reliably protected.

In this preferred embodiment, the contact detector is a wire. Therefore, vibration can be easily transferred to the wire. In addition, wires can be easily handled and have low cost.

Furthermore, in this preferred embodiment, the first wire 63R is engaged with the first plate spring 68R in a deformed state. The first wire 63R is pulled by a restoring force of the first plate spring 68R. Thus, a tension of the first wire 63R can be kept constant. Therefore, the ease of transferring vibration is constant and the application of vibration to the first wire 63R and detection of vibration from the first wire 63R are stabilized. This similarly applies to the second wire 63F. The elastic body that applies a constant tension to the wire is a plate spring herein but some other elastic body, such as, for example, a coil spring or the like, may be used.

In this preferred embodiment, each of the first oscillator 61R and the second oscillator 61F includes a piezoelectric element. Piezoelectric elements are low in cost, and therefore, according to the above-described configuration, the cost for the first oscillator 61R and the second oscillator 61F can be reduced. In this preferred embodiment, each of both the first vibration detector 62R and the second vibration detector 62F includes a piezoelectric element and the costs of the first vibration detector 62R and the second vibration detector 62F are reduced. However, each of the oscillators may include some other vibration generation device than a piezoelectric element and each of the vibration detectors may include some other vibration measuring device than a piezoelectric element.

In this preferred embodiment, each of the oscillation frequencies of the first oscillator 61R and the second oscillator 61F is set to about 10 kHz or more. These frequencies are largely different from a frequency of vibration that is assumed to be applied to the first wire 63R and the second wire 63F due to a disturbance factor, such as shake of the printer 10 or the like. Therefore, according to the above-described configuration, detection of an obstacle is less likely to be affected by a disturbance factor.

The printer 10 according to this preferred embodiment is configured to give a warning when it is determined that an object has come into contact with the first wire 63R or the second wire 63F while the recording medium 5 moves in the sub scanning direction X. The first wire 63R and the second wire 63F extend in the main scanning direction Y orthogonal to the sub scanning direction X. Therefore, according to the above-described configuration, even when an obstacle that is likely to come into contact with the recording head 40 while the recording medium 5 moves in the sub scanning direction X appears, some actions of stopping the flatbed 20 or the like can be performed by warning.

The printer 10 according to this preferred embodiment is configured to register the upper limit position of the flatbed 20, based on the position of the flatbed 20 in the up-down direction when it is determined that an object has come into contact with the first wire 63R or the second wire 63F. According to the above-described configuration, the upper limit position of the flatbed 20 can be highly accurately set by the contact detector 60 having high position accuracy. As described above, there is no particular limitation on a relationship between the position of the flatbed 20 in the up-down direction when it is determined that an object has come into contact with the first wire 63R or the second wire 63F and the upper limit position of the flatbed 20.

The printer 10 according to this preferred embodiment is configured to move the flatbed 20 in the X1 direction or in the X2 direction each time the flatbed 20 is moved upward in registering the upper limit position of the flatbed 20. According to the above-described configuration, both when the flatbed 20 is moved in the X1 direction and when the flatbed 20 is moved in the X2 direction, the upper limit position of the flatbed 20 can be found. Therefore, a throughput related to registration of the upper limit position of the flatbed 20 can be increased. In order to increase the throughput related to registration of the upper limit position of the flatbed 20, the number of contact detectors may be one, and the flatbed 20 may move in the X1 direction and the X2 direction.

Preferred embodiments have been described above. However, inkjet printers according to the present invention are not limited to the above-described preferred embodiments.

Figure 10:
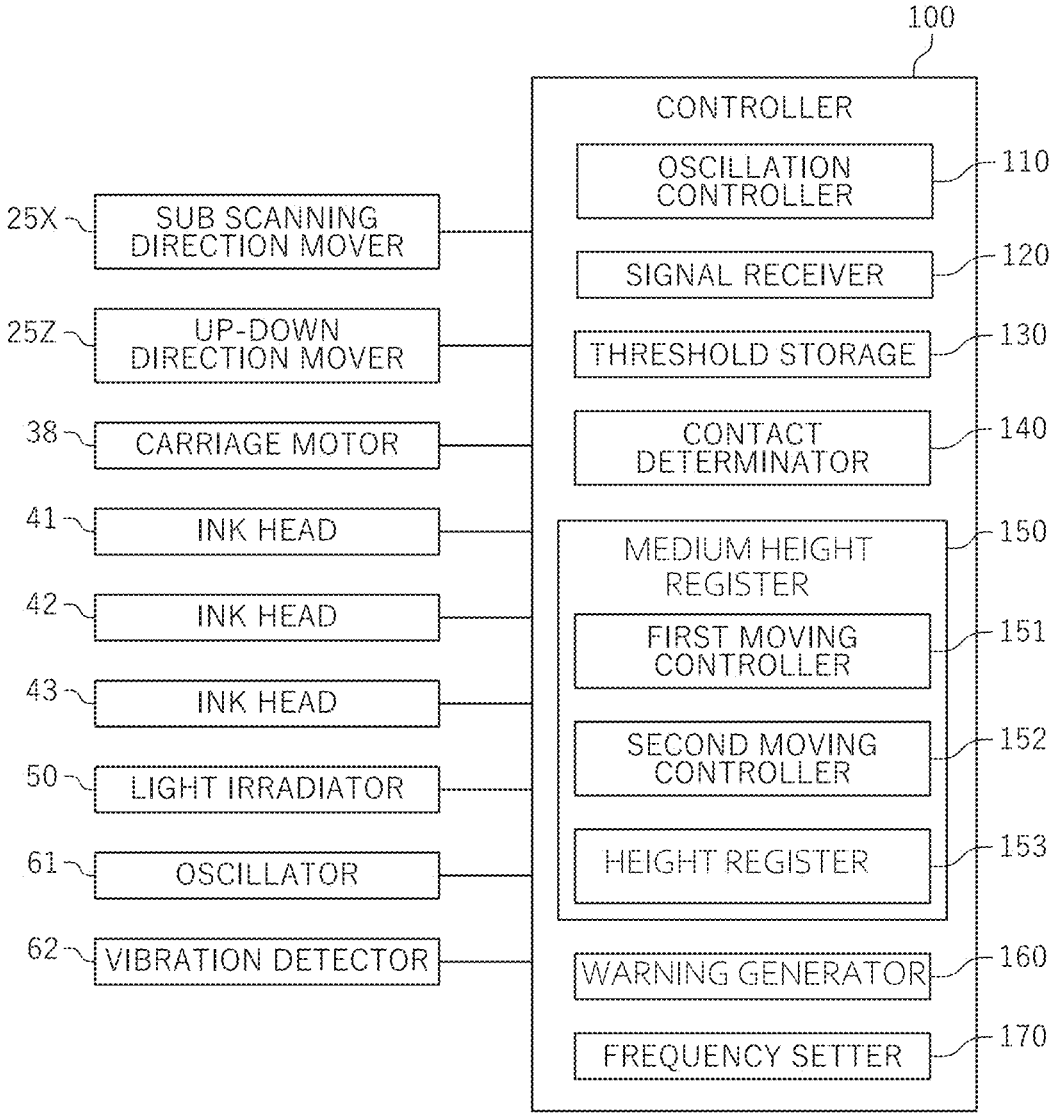
FIG. 10 is a block diagram of a printer according to a modified preferred embodiment of the present invention.

For example, in one modified preferred embodiment, a plurality of wires may be vibrated by one oscillator and vibrations of the plurality of wires may be detected by one vibration detector. FIG. 10 is a block diagram of a printer 10 according to the one modified preferred embodiment. In the following description of this modified preferred embodiment, each member having a common function with a corresponding member in the above-described preferred embodiment is denoted by the same reference character as that used in the above-described preferred embodiment. As illustrated in FIG. 10, a controller 100 according to this modified preferred embodiment includes an oscillator 61 that vibrates a first wire 63R and a second wire 63F and a vibration detector 62 that detects combined vibration of the first wire 63R and the second wire 63F and transmits a signal corresponding to the detected vibration. In this modified preferred embodiment, each of the number of oscillators and the number of vibration detectors is one, and the number of wires is two. The controller 100 includes an oscillation controller 110 that controls the oscillator 61, a signal receiver 120 that receives a signal from the vibration detector 62, and a contact determinator 140 that determines that an object has come into contact with the first wire 63R or the second wire 63F when the vibration detected by the vibration detector 62 is equal to or lower than a threshold stored in a threshold storage 130.

In this modified preferred embodiment, the oscillator 61 is coupled to the first wire 63R and the second wire 63F and vibrates the first wire 63R and the second wire 63F. The vibration detector 62 is coupled to both the first wire 63R and the second wire 63F. Therefore, the vibration detector 62 detects combined vibration of the first wire 63R and the second wire 63F. According to the above-described configuration, the number of oscillators and the number of vibration detectors can be reduced, and therefore, a contact detection device can be configured at lower cost. A plurality of wires may be vibrated by one oscillator and vibrations of the plurality of wires may be detected by a plurality of vibration detectors. According to this configuration, the contact detection device can be also configured at lower cost. Also, similar to the above-described preferred embodiment, with which one of the plurality of wires an object has come into contact can be determined.

As illustrated in FIG. 10, the controller 100 according to this modified preferred embodiment includes a frequency setter 170 that sets an oscillation frequency of the oscillator 61 in a preset frequency range. Herein, the frequency setter 170 is configured to automatically set a frequency at which a resonance between the first wire 63R and the second wire 63F is largest. In other words, the frequency setter 170 sets the oscillation frequency of the oscillator 61 to a frequency at which an amplitude of the combined vibration of the first wire 63R and the second wire 63F detected by the vibration detector 62 is largest.

In this modified preferred embodiment, the oscillator 61 vibrates the first wire 63R and the second wire 63F. Therefore, depending on conditions, the frequency of the vibration of the first wire 63R and the frequency of the vibration of the second wire 63F are different from each other in some cases. In such a case, the vibration of the first wire 63R and the vibration of the second wire 63F partially offset each other and energy efficiency is low. Detection sensitivity is also likely to be reduced. Therefore, in this modified preferred embodiment, the oscillation frequency of the oscillator 61 is automatically set to the frequency at which the amplitude of the combined vibration of the first wire 63R and the second wire 63F is largest. Thus, energy efficiency related to the vibrations of the first wire 63R and the second wire 63F is increased. A probability that the detection sensitivity is reduced is lowered.

Herein, the frequency setter 170 is configured to search the frequency at which the amplitude of the vibration detected by the vibration detector 62 is largest while changing the frequency of the oscillator 61 in the preset frequency range.

The frequency setter 170 may be configured to set a frequency of oscillation vibration of the oscillator 61 each time the oscillator 61 is used or in some other timing. The frequency setter 170 may be also configured to set the oscillation frequency of the oscillator 61, for example, only at a time of initial setting. The frequency setter 170 may be configured to set the oscillation frequency of the oscillator 61, for example, only when a user instructs so. As another option, the frequency setter 170 may be configured to set the oscillation frequency of the oscillator 61, for example, on a regular basis or in accordance with frequency of use of the printer 10.

In the above-described modified preferred embodiment, an intensity (amplitude) of the vibration of the oscillator 61 is fixed but may be automatically set to a proper intensity by the controller 100.

The above-described preferred embodiments do not limit the present invention unless specifically stated otherwise.

For example, in the above-described preferred embodiments and modified preferred embodiment, the number of vibration detectors is the same as the number of oscillators or is larger than the number of oscillators, but the number of vibration detectors is not limited thereto. Moreover, in the above-described preferred embodiments and modified preferred embodiment, the number of wires is the same as the number of vibration detectors or larger than the number of vibration detectors, but the number of wires is not limited thereto. As long as each of the number of oscillators, the number of vibration detectors, and the number of contact detectors is one or more, the number of oscillators, the number of vibration detectors, and the number of contact detectors are not limited.

In the above-described preferred embodiments, the printer 10 is a flatbed-type printer, but there is no particular limitation on a configuration of the printer. For example, a technology disclosed herein may be applied to a type of printer configured such that a recording medium is fed from a roll. In that case, a conveyance direction of the recording medium corresponds to the sub scanning direction X. Unlike the above-described preferred embodiments in which the recording medium is moved with the flatbed 20 in the sub scanning direction X, the recording medium may be moved in the conveyance direction on a platen. Moreover, a printer according to a preferred embodiment of the present invention is not limited to a printer that uses a photocurable ink and includes a light irradiator.

In the above-described preferred embodiments, the flatbed 20 and the recording medium 5 are moved in the sub scanning direction X and the main scanning direction Y, but movements of the flatbed 20 and the recording medium 5 are not limited thereto. A supporting table and a recording medium are in a relative positional relationship and there is no limitation on which one of the supporting table and the recording medium is moved in changing the positional relationship. The mover that changes a positional relationship between the supporting table or the recording medium and a recording head may be configured to move at least one of the supporting table and the recording head or move at least one of the recording medium and the recording head. For example, the mover may be configured to move the recording head in the up-down direction and a direction orthogonal to an extending direction of the contact detector. In the technology provided herein, "moving A relative to B" means the above-described relative movement and includes moving B as well.

In the above-described preferred embodiments, one wire serving as the contact detector is provided in each of a position forward of and a position rearward of the recording head, but an arrangement of the wires is not limited thereto. The contact detector is not limited to a wire, and also, there is not particular limitation on the number of contact detectors. For example, the number of contact detectors may be one and may be three or more.

The terms and expressions used herein are for description only and are not to be interpreted in a limited sense. These terms and expressions should be recognized as not excluding any equivalents to the elements shown and described herein and as allowing any modification encompassed in the scope of the claims. The present invention may be embodied in many various forms. This invention should be regarded as providing preferred embodiments of the principles of the present invention. These preferred embodiments are provided with the understanding that they are not intended to limit the present invention to the preferred embodiments described in the specification and/or shown in the drawings. The present invention is not limited to the preferred embodiments described herein. The present invention encompasses any of preferred embodiments including equivalent elements, modifications, deletions, combinations, improvements and/or alterations which can be recognized by a person of ordinary skill in the art based on the invention. The elements of each claim should be interpreted broadly based on the terms used in the claim, and should not be limited to any of the preferred embodiments described in this specification or referred to during the prosecution of the present application.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A printer comprising:

a supporting table to support a recording medium;

a recording head located above the supporting table to eject ink toward the supporting table;

a first contact detector located above the supporting table and lower than the recording head;

an oscillator to vibrate the first contact detector;

a vibration detector to detect vibration of the first contact detector and transmit a signal corresponding to the detected vibration; and a controller; wherein the controller is configured or programmed to include:

a signal receiver to receive a signal from the vibration detector;

a threshold storage to store a threshold related to the vibration of the first contact detector; and a contact determinator to determine that an object has come into contact with the first contact detector when an amount of the vibration detected by the vibration detector is equal to the threshold or less.

2. The printer according to claim 1, wherein the first contact detector includes a wire and is above the supporting table and lower than the recording head to extend parallel or substantially parallel to the supporting table.

3. The printer according to claim 2, wherein the wire has one end engaged with an elastic body in a deformed state and is pulled by a restoring force of the elastic body.

4. The printer according to claim 1, wherein the oscillator includes a piezoelectric element.

5. The printer according to claim 1, wherein an oscillation frequency of the oscillator is about 10 kHz or more.

6. The printer according to claim 1, further comprising:

a mover to move the recording medium; wherein the supporting table extends in a first direction and a second direction orthogonal or substantially orthogonal to the first direction;

the first contact detector extends in the first direction;

the mover moves the recording medium relative to the recording head in the second direction; and the controller is configured or programmed to include a warning generator to provide a warning when the contact determinator determines that an object has come into contact with the first contact detector while the recording medium is moved relative to the recording medium in the second direction.

7. The printer according to claim 6, further comprising:

a second contact detector; wherein the first contact detector is provided farther in one side than the recording head in the second direction; and the second contact detector is provided farther in the other side than the recording head in the second direction and extends in the first direction.

8. The printer according to claim 7, wherein the oscillator vibrates the second contact detector.

9. The printer according to claim 8, wherein the vibration detector is configured to detect combined vibration of the first contact detector and the second contact detector and transmit a signal corresponding to the detected vibration;

the controller is configured or programmed to include a frequency setter to set the oscillation frequency of the oscillator within a preset frequency range; and the frequency setter sets the oscillation frequency of the oscillator to a frequency at which an amplitude of the combined vibration detected by the vibration detector is largest.

10. The printer according to claim 1, further comprising:

a first mover to move the supporting table relative to the recording head in an up-down direction; wherein the controller is configured or programmed to include:

a first moving controller configured or programmed to control the first mover to move the supporting table supporting the recording medium up and down relative to the recording head; and a height register in which an upper limit position of the supporting table is registered based on a position of the supporting table relative to the recording head in the up-down direction when the contact determinator determines that an object has come into contact with the first contact detector.

11. The printer according to claim 10, comprising:

a second mover to move the supporting table; wherein the supporting table extends in a first direction and a second direction orthogonal or substantially orthogonal to the first direction;

the first contact detector extends in the first direction;

the second mover moves the supporting table relative to the recording head in the second direction;

the first moving controller is configured or programmed to intermittently move the supporting table upward relative to the recording medium; and the controller is configured or programmed to include a second moving controller configured or programmed to control the second mover to move the supporting table relative to the recording head to one side or the other side in the second direction each time the supporting table is moved upward relative to the recording head by control performed by the first moving controller.

* * * * *